US007731550B2

(12) United States Patent
Falchetti

(10) Patent No.: US 7,731,550 B2
(45) Date of Patent: Jun. 8, 2010

(54) ELECTRIC CONNECTOR

(75) Inventor: Antonio Falchetti, Codogno (IT)

(73) Assignee: MTA, S.p.A., Codogno (IT)

( * ) Notice: Subject to any disclaimer, the term of this patent is extended or adjusted under 35 U.S.C. 154(b) by 0 days.

(21) Appl. No.: 12/078,548

(22) Filed: Apr. 1, 2008

(65) Prior Publication Data

US 2008/0254687 A1 Oct. 16, 2008

(30) Foreign Application Priority Data

Apr. 12, 2007 (EP) ..... 07425209

(51) Int. Cl.
*H01R 13/11* (2006.01)

(52) U.S. Cl. ..... 439/857; 439/843

(58) Field of Classification Search ..... 439/857, 439/856, 861, 839, 843, 844
See application file for complete search history.

(56) References Cited

U.S. PATENT DOCUMENTS 5,007,865 A * 4/1991 Jakobeit ..... 439/839
5,415,571 A * 5/1995 Lutsch ..... 439/843
5,551,897 A * 9/1996 Alwine ..... 439/850
5,681,190 A * 10/1997 Childs ..... 439/856
6,386,928 B2 * 5/2002 Kitamura ..... 439/852
6,511,336 B1 1/2003 Turek et al.
6,840,824 B2 * 1/2005 Harada et al. ..... 439/857
2006/0292937 A1 * 12/2006 Morello et al. ..... 439/856

FOREIGN PATENT DOCUMENTS

DE 196 18 928 11/1997

OTHER PUBLICATIONS

European Search Report for 07425209 mailed Oct. 23, 2007.

* cited by examiner

*Primary Examiner*—Hien Vu
(74) *Attorney, Agent, or Firm*—Nixon & Vanderhye PC

(57) ABSTRACT

An electric connector (1) has an attachment portion (2) for attachment to an electric conductor, a connecting portion (3) for connection to a mating electric connector, and a damping portion (4) which joins the attachment portion (2) to the connecting portion (3) and comprises a bottom wall (5) connected to one of the two portions and a top wall (6) connected to the other of the two portions. The bottom wall (5) and the top wall (6) lie on advantageously parallel planes, and are connected by one side wall (7).

6 Claims, 8 Drawing Sheets

ELECTRIC CONNECTOR

The present invention relates to an electric connector.

A prior art electric connector is disclosed, for instance, in EP 1 047 152. This electric connector has an attachment portion for attachment to an electric conductor, a connecting portion for connection to a mating connector and a spring element interposed between such two portions. The spring element is incorporated in the connecting portion and at least partly forms one of the surfaces that surround the connecting portion.

Particularly, the spring element has an approximately Z-shaped longitudinal section, with one leg of the Z-shaped member incorporated in the attachment portion and the other leg of the Z-shaped member incorporated in the connecting portion. The longitudinal Z-shape of the spring element affords vibration damping along the longitudinal axis of the connector and along the vertical axis perpendicular thereto, but is poorly efficient when transverse vibration damping on the electric connector is required.

Another prior art electric connector is disclosed, for instance, in EP 979 543. This electric connector has an attachment portion for attachment to an electric conductor, a connecting portion for connection to a mating connector and a substantially box-like element interposed between such two portions.

The box-like element has a bottom wall, connected to the attachment portion, with two opposed side walls extending therefrom. Each side wall is connected to a top wall having a spring contact element extending therefrom. This structure provides vibration damping along the vertical axis. Nevertheless, this structure is ineffective in that it is intrinsically rigid when subjected to vibration along the longitudinal direction and along the transverse direction.

The need arises from the above for a connector having an improved damping effectiveness when subjected to any vibration, i.e. in the longitudinal, transverse and vertical or multi-axial directions.

Therefore, the object of this invention is to provide an electric connector that has such features as to fulfill the above need, while obviating the drawbacks of prior art.

This object is fulfilled by an electric connector in accordance with claim 1.

Thanks to the particular arrangement of the damping portion, the electric connector damps any vibration, in the longitudinal, transverse, vertical and torsional directions.

Figure 1:
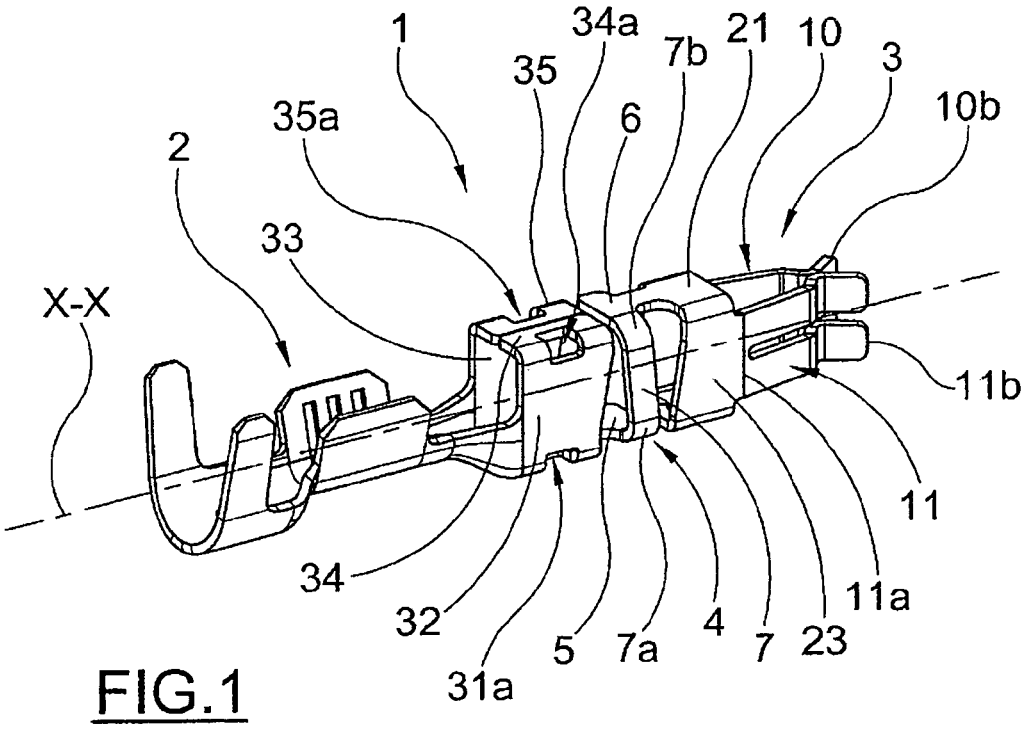
Figure 2:
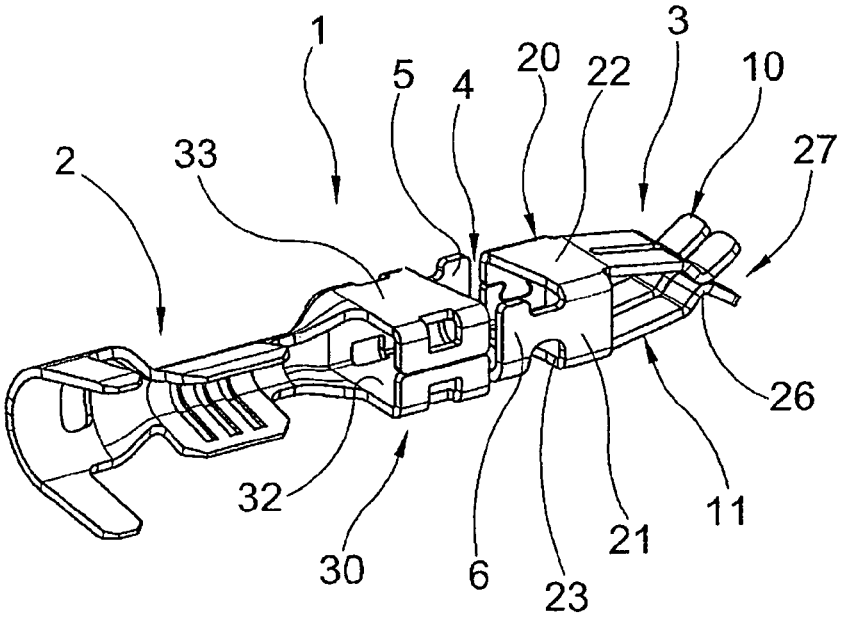
Figure 3:
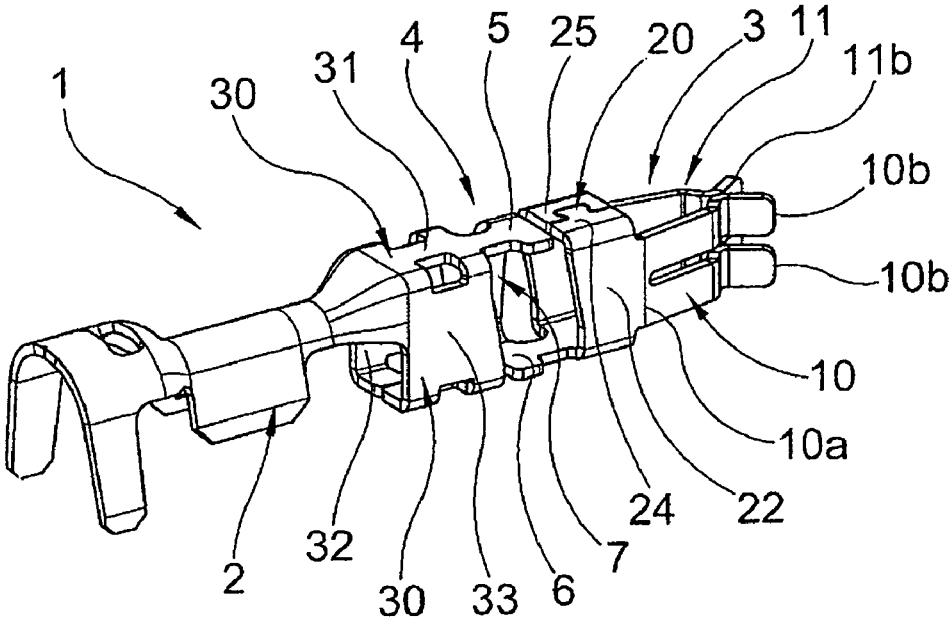
Figure 4:
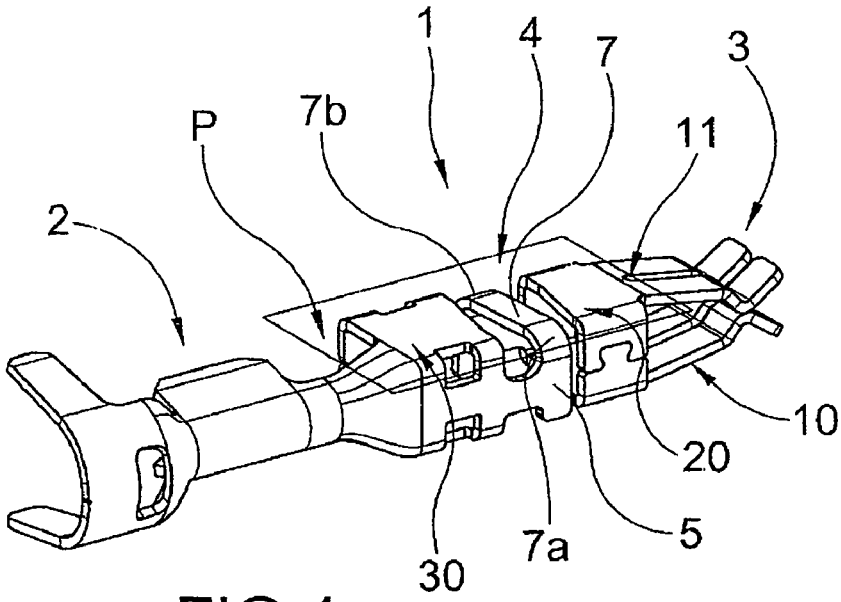
Figure 5:
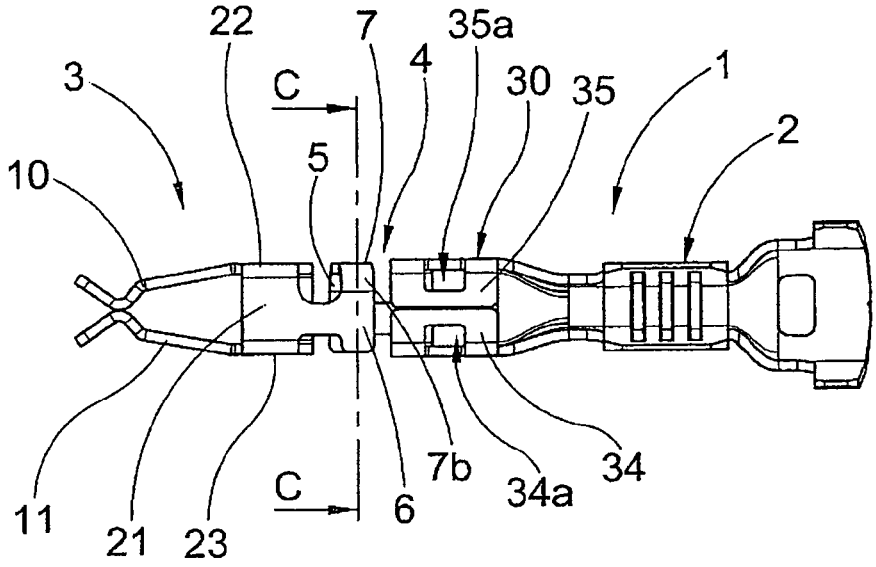
Figure 6:
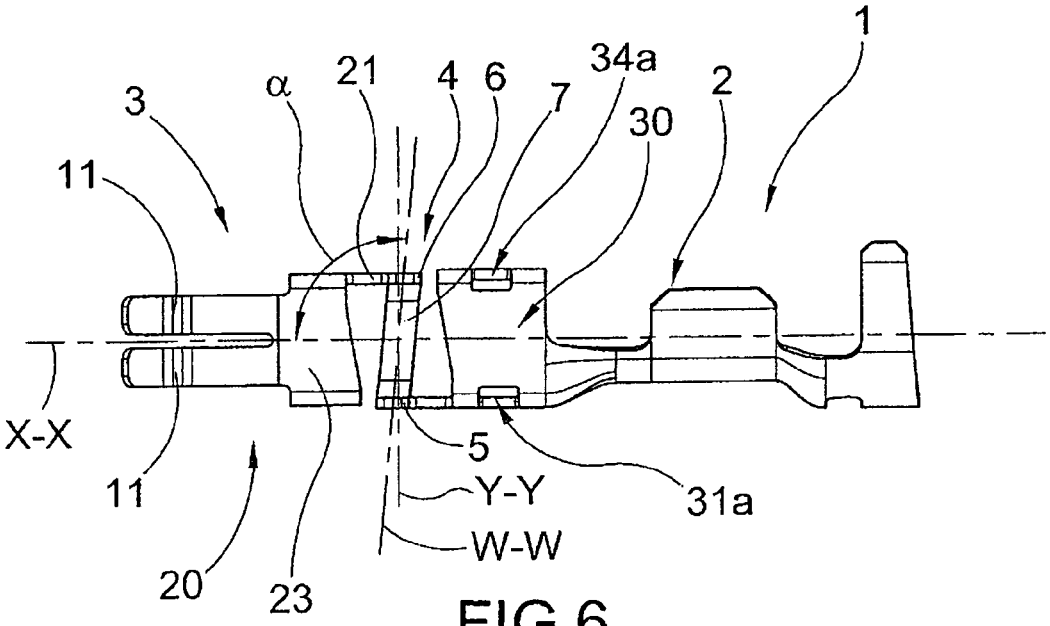
Figure 7:
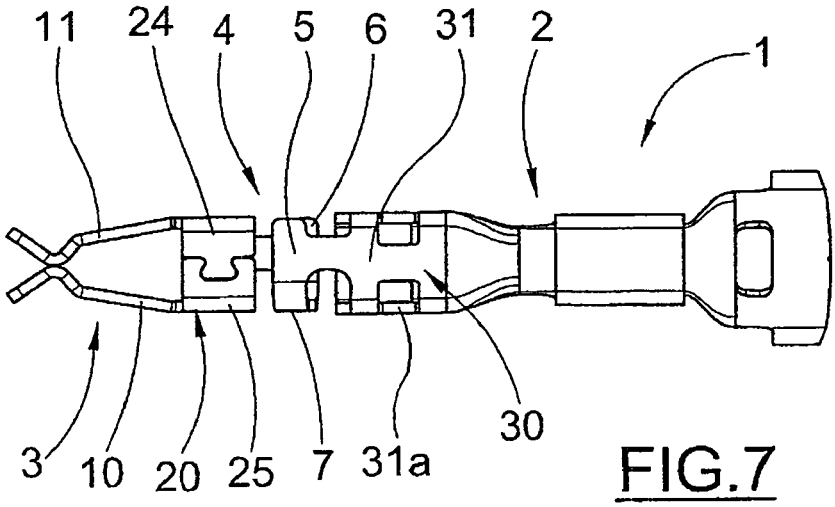
Figure 8:
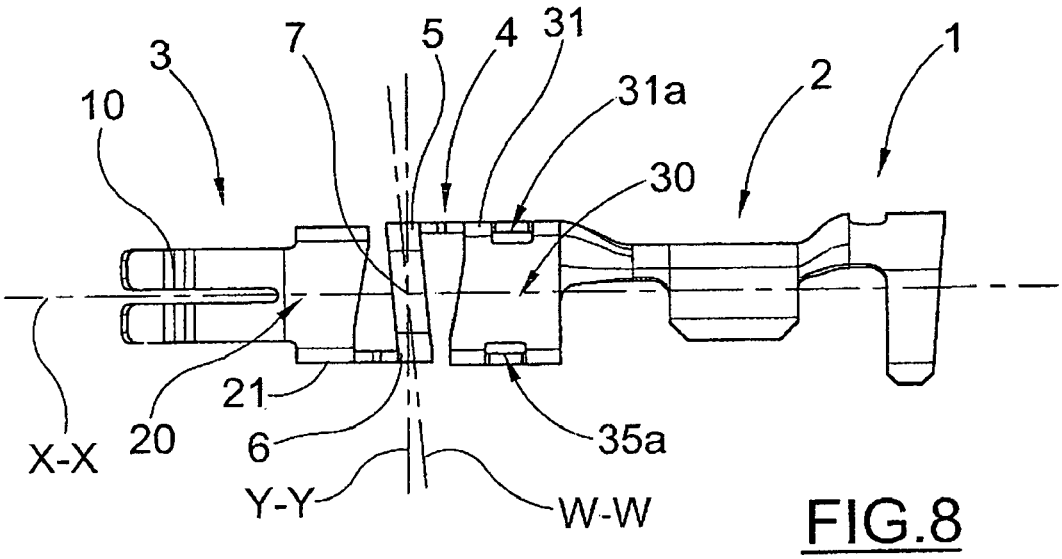
Figure 9:
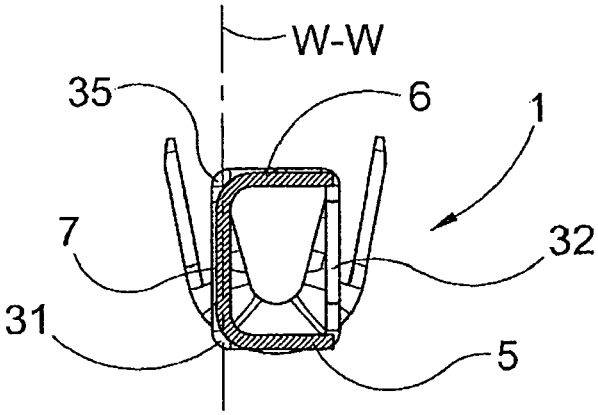
Figure 10:
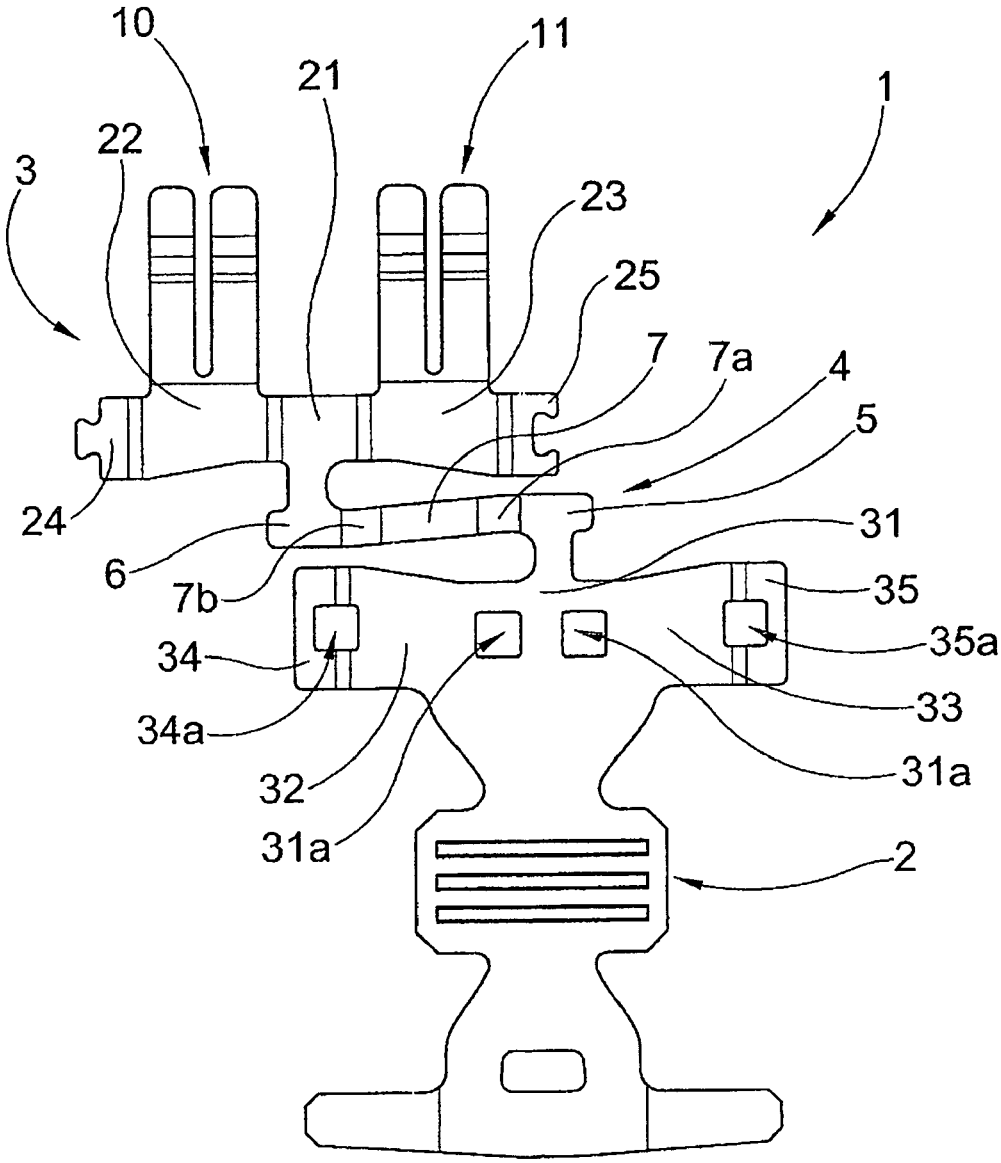
Figure 11:
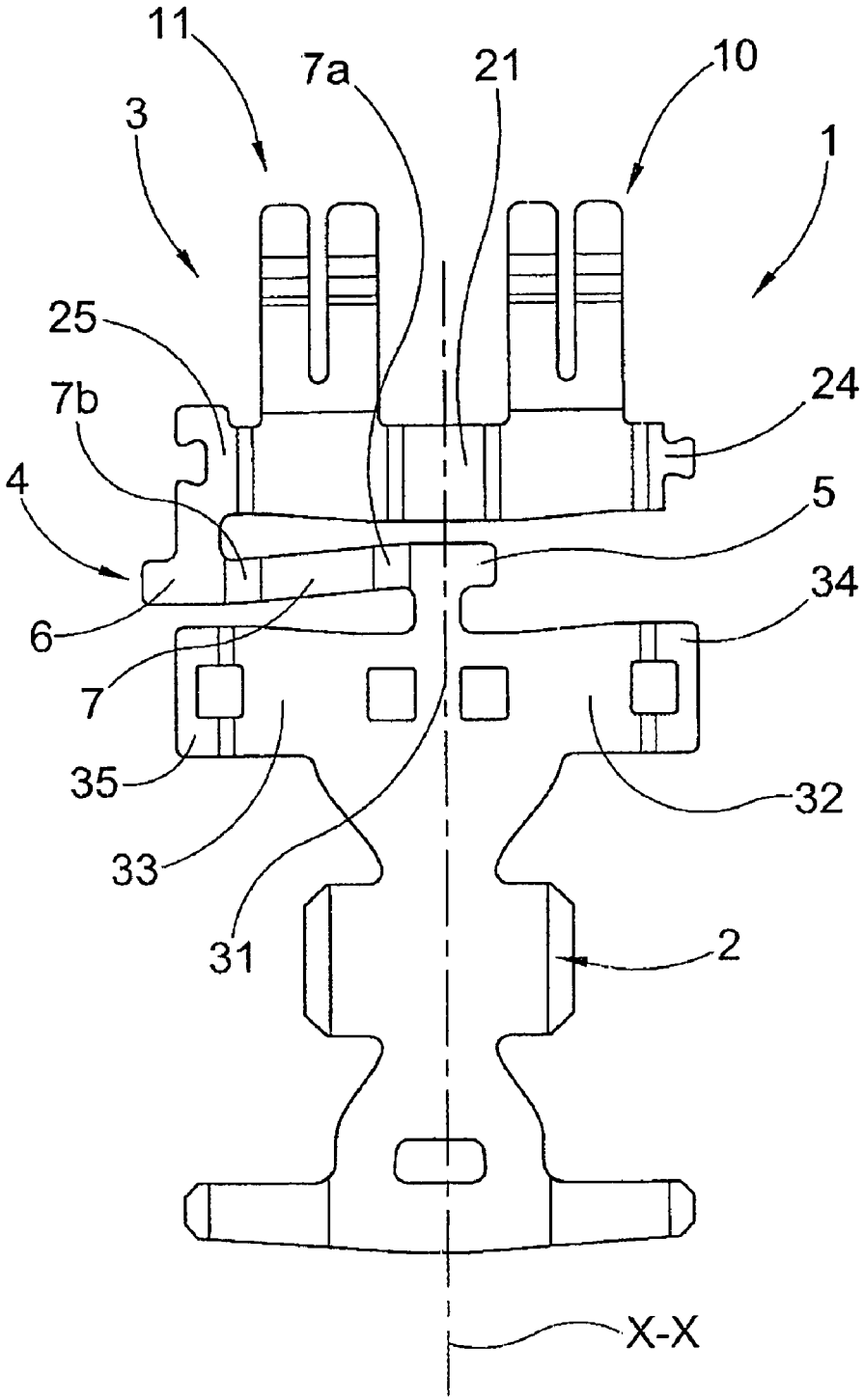
Figure 12:
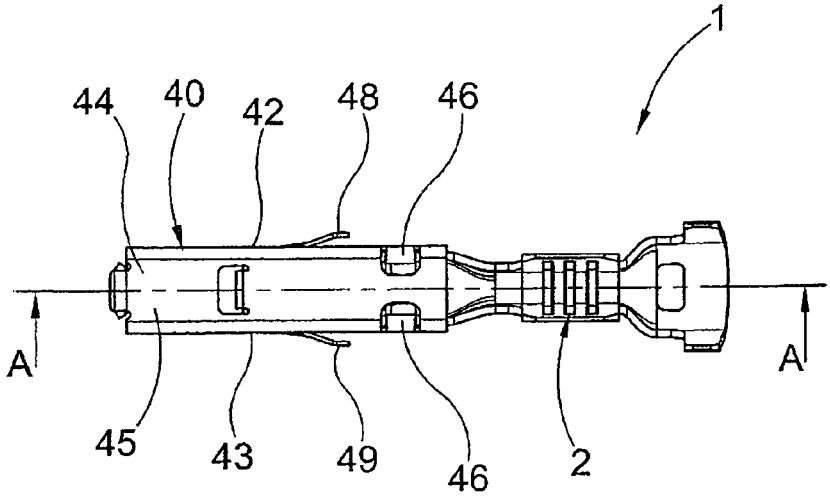
Figure 13:
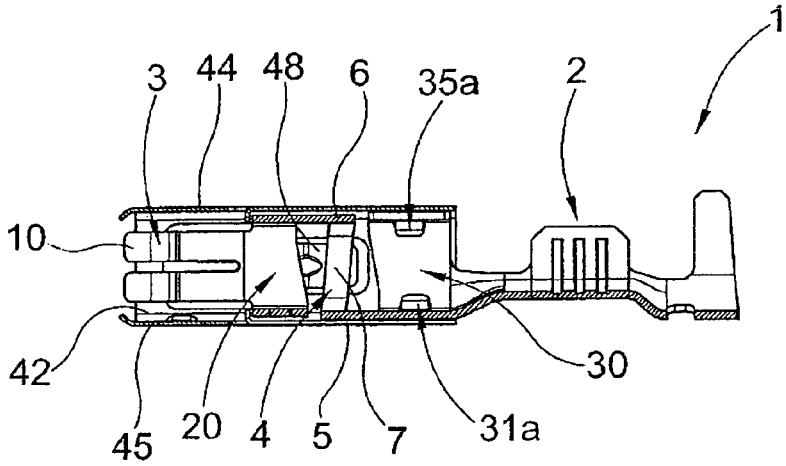
Figure 14:
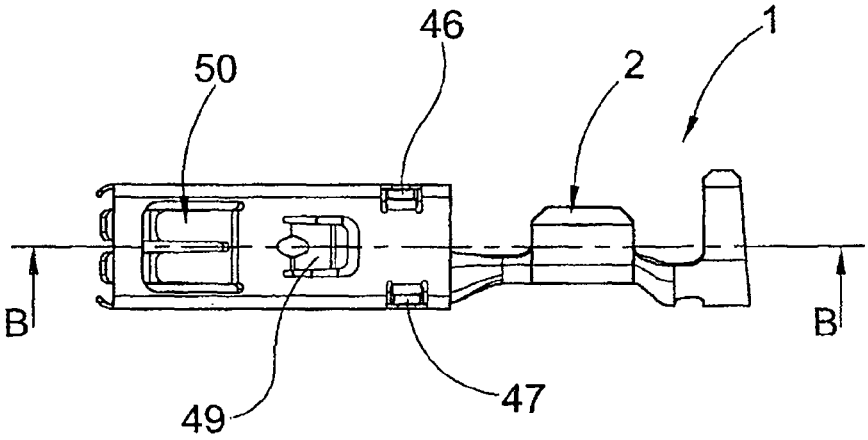
Figure 15:
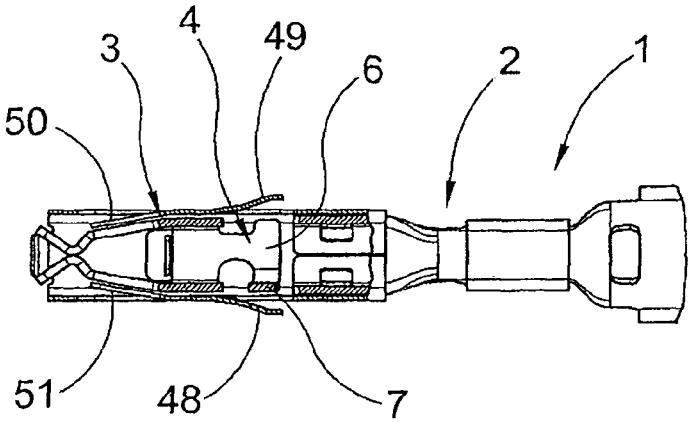

Further features and advantages of the electric connector of this invention will be apparent from the following description of one preferred embodiment thereof, which is given by way of illustration and without limitation with reference to the accompanying figures, in which:

FIG. 1 is a perspective view of an electric connector of the present invention, FIGS. 2 to 4 are different perspective views of the electric connector of FIG. 1, FIG. 5 is a top plan view of the electric connector of FIG. 1, FIG. 6 is a side plan view of the electric connector of FIG. 1, FIG. 7 is a bottom plan view of the electric connector of FIG. 1, FIG. 8 is a side plan view of the electric connector of FIG. 1, as viewed from the opposite side with respect to FIG. 6, FIG. 9 is a cross-section of the electric connector of FIG. 1, as taken along the section line C-C of FIG. 5, FIG. 10 is a plan view of the blank that is used for forming the electric connector of FIG. 1, by successive folding steps, FIG. 11 is a plan view of a second embodiment of the blank to be used for forming the electric connector of FIG. 1, by successive folding steps, FIG. 12 is a top plan view of the electric connector of FIG. 1, with a clip mounted thereon, FIG. 13 is a cross-section of the electric connector of FIG. 12, as taken along the section line A-A of FIG. 12, FIG. 14 is a side plan view of the electric connector of FIG. 12, and FIG. 15 is a cross-section of the electric connector of FIG. 12, as taken along the section line B-B of FIG. 14.

Referring to the accompanying figures, numeral 1 generally designates an electric connector of the present invention.

The electric connector extends along a main longitudinal direction X-X and has an attachment portion for attachment to an electric conductor (not shown), a connecting portion 3 for connection to a mating electric connector (not shown), and a damping portion 4 which joins the attachment portion 2 to the connecting portion 3.

The damping portion 4 comprises a first wall 5 connected to one of the two portions 2, 3, here to the attachment portion 2, and a second wall 6 connected to the other of the two portions 2, 3, here to the connecting portion 3.

The first wall 5 and the second wall 6 lie on advantageously parallel planes. According to the embodiment as shown in the annexed figures, the first wall 5 is a bottom wall and the second wall 6 is a top wall, such bottom and top walls 5, 6 lying on respective parallel planes.

Particularly, the damping portion 4 comprises a single side wall 7 which joins the bottom wall 5 and the top wall 6. In other words, the bottom wall 5 and the top wall 6 are joined together by one side wall 7.

It was surprisingly found that the use of a single side wall for joining the two opposite bottom and top walls connecting to the attachment portion and the connecting portion respectively allows damping of any vibration, i.e. in the longitudinal, transverse and vertical directions, and in any case multi-axial vibration.

Namely, the lack of a second retaining member, i.e. a second opposite side wall, for connecting the bottom and top walls provides almost full vibration damping along the vertical axis, as well as transverse and longitudinal vibration damping. Furthermore, this structure of the damping portion was found to be surprisingly effective for torsional and rotational vibration damping, thereby providing reliability and stability to the electric connection between two mating electric connectors.

Advantageously, the side wall 7 extends in a direction W-W transverse to the bottom and top walls 5, 6, i.e. transverse to the two parallel planes on which such bottom and top walls 5, 6 lie.

Particularly, the side wall 7 may extend in a direction W-W perpendicular to the bottom and top walls 5, 6, i.e. perpendicular to the two parallel planes on which such bottom and top walls 5, 6 lie.

The side wall 7 has a first end 7*a* connected to the bottom wall 5 and a second end 7*b* connected to the top wall 6. According to one embodiment of the invention, the direction W-W along which the side wall 7 extends, from the first end 7*a* to the second end 7*b*, forms an angle $\alpha$ with the longitudinal direction X-X of the electric connector 1.

Advantageously, the angle $\alpha$ is in a range from 60° to 120°, preferably from 80° to 100°, in the example as shown (FIGS. 6 and 8) of 95°.

In other words, the direction W-W along which the side wall 7 extends is inclined with respect to the vertical direction Y-Y, perpendicular to the longitudinal direction X-X of the electric connector 1. The inclination angle is obviously advantageously in a range from −30° to 30°, preferably from −10° to 10°, in the example as shown (FIGS. 6 and 8) of 5°.

As shown by the figures, the presence of a single side wall for joining the bottom and top walls 5, 6 causes the side wall 7 to be offset from the longitudinal axis X-X of the connector, i.e. the side wall 7 extends between the top wall 6 and the bottom wall 5 along one side of the electric connector 1 only.

Particularly, the side wall 7 is offset from the plane P of the longitudinal axis X-X and perpendicular to the parallel planes of the walls 5, 6. In other words, the side wall 7 lies on a plane parallel to the plane P of the longitudinal axis X-X and perpendicular to the parallel planes of the walls 5, 6.

As a result, the damping portion 4 is asymmetric with respect to the longitudinal axis X-X of the connector 1. Particularly, the damping portion 4 is asymmetric with respect to the plane P of the longitudinal axis X-X and perpendicular to the parallel planes of the walls 5, 6.

The connecting portion 3 comprises at least two opposite spring contact elements 10, 11, which are connected at a first end 10*a*, 11*a* to a substantially box-like element 20 connected to the top wall 6 of the damping portion 4.

The particular form of the damping portion 4 allows the side wall to exert torsional stresses about its own axis W-W in addition to compressive and bending stresses.

The substantially box-like element 20 extends along the longitudinal axis X-X and comprises a top wall 21, which is connected to the top wall 6 of the damping portion 4. Two opposite parallel side walls 22, 23 extend from the top wall 21 and terminate in two coplanar lower wings 24, 25 parallel to the top wall 21. The two lower wings 24, 25 are fixed together, here by a dovetail form fit, to define the box-like element 20.

The opposite spring contact elements 10, 11, here two contact elements for each side wall 22, 23 extend from the two side walls 22, 23.

Here, the side wall 21 carries the two contact elements 10 and the opposite side wall 22 carries the two opposite contact elements 11.

The opposite spring contact elements 10, 11 extend, from the first ends 10*a*, 11*a*, in a main longitudinal direction X-X, to free ends 10*b*, 11*b*. Particularly, the spring contact elements 10, 11 extend from the box-like element 20 and are initially directed toward each other to a point of mutual contact 26 and diverge from such point of contact 26 to form a receiving area 27 for a mating electric connector.

According to the embodiment of the figures, the electric connector 1 has a second substantially box-like element 30 connected to the bottom wall 5 of the damping portion 4 and interposed between the bottom wall 5 of the damping portion 4 and the attachment portion 2.

The second substantially box-like element 30 also mainly extends along the longitudinal axis X-X of the connector 1 and comprises a bottom wall 31, which is connected to the bottom wall 5 of the damping portion 4. Two opposite parallel side walls 32, 33 extend from the bottom wall 31 and terminate in two coplanar upper wings 34, 35 parallel to the bottom wall 31. Here, the two upper wings 34, 35 are not fixed together. Otherwise, fixing arrangements may be provided, i.e. dovetail form fits, spot welding and the like.

Advantageously, each of the two upper wings 34, 35 has a receptacle 34*a*, 35*a* for receiving a locking tab, as described in greater detail hereinbelow. Opposite receptacles 31*a* are formed in the bottom wall 31.

FIG. 10 shows a plan view of the blank that is used for forming the electric connector of FIG. 1, by successive folding steps, whereas FIG. 11 shows a plan view of a second embodiment of the blank to be used for forming the electric connector of FIG. 1, by successive folding operations.

It will be appreciated that the blank of FIG. 11 is different from the blank of FIG. 10 in that the top wall 6 of the damping portion 4 is connected to the upper wing 25 of the substantially box-like element 20 which, according to this embodiment, comprises a bottom wall 21 from which the two opposite parallel opposite side walls 22, 23, which terminate in two coplanar upper wings 24, 25 parallel to the bottom wall 21. This embodiment provides material savings in the blanking steps because, as shown by FIG. 11, the bottom wall 5 of the damping portion 4 is aligned with the bottom wall 21 of the box-like element 20. Conversely, the blank of FIG. 10 has its bottom wall 5 not aligned with the top wall 21 of the box-like element 20.

The blanks of FIGS. 10 and 11, obtained by blanking a sheet of electrically conductive material, the connector 1 is formed in a manner known per se, through successive folding steps. According to one embodiment, the damping portion 4 is surrounded by an external spring element 40 for protecting the damping portion 4. Advantageously, the external spring element 40 also surrounds the connecting portion 3 to protect the internal spring contact elements 10, 11.

As shown in the figures, the external spring element 40 is rigidly fixed to the connecting portion 3 of the electric connector 1 by inwardly folded tabs 46, 47 for engaging the corresponding receptacles 34*a*, 35*a* formed in the wings 34, 35 and the receptacles 31*a* of the bottom wall 31 of the box-like element 30 of the electric connector 1. Particularly, the tabs 46, 47 provide axial locking of the external spring element 40, along the axis X-X, on the electric connector 1.

In the example of FIGS. 10 to 13, the external spring element 40 is a clip, e.g. made of steel, comprising a bottom wall 41, from which two parallel opposite side walls 42, 43 extend and terminate in two coplanar upper wings 44, 45 fixed together, e.g. by welding. As shown by the annexed figures, the tabs 46, 46 are formed in the upper wings 44, 45.

The clip 40 further comprises two opposite tabs 48, 49 protruding from the two opposite side walls 42, 43 for locking the electric connector 1 in a connector housing.

The clip 40 further comprises two pairs of opposite spring elements 50, 51 formed in the two opposite side walls 42, 43, whose action is exerted inwardly from the outside onto the internal spring contact elements 10, 11. As clearly shown in the above description, the electric connector of the present invention obviates the above mentioned prior art drawbacks. Namely, the electric connector of the present invention damps any vibration, in the longitudinal, transverse and vertical directions. As a result, the electric connector of the present invention damps vibration exerted along three axes, in the longitudinal, transverse and vertical directions, or multiaxial vibration.

Those skilled in the art will obviously appreciate that a number of changes and variants may be made to the electric connector of the invention as described hereinbefore to meet specific needs, without departure from the scope of the invention, as defined in the following claims.

The invention claimed is:

1. An electric connector extending along a longitudinal direction, said electric connector comprising:

an attachment portion for attachment to an electric conductor, a connecting portion for connecting to a mating electric connector, a damping portion which joins said attachment portion to said connecting portion and comprises a bottom wall connected to one of said attachment and connecting portions and a top wall connected to the other portion of said attachment and connecting portions, wherein said bottom wall and said top wall lie on respective parallel planes, said damping portion comprises a single side wall which joins said bottom wall and said top wall, thereby joining said attachment portion and said connecting portion, said side wall has a first end connected to said bottom wall and a second end connected to said top wall, said side wall extends, from said first end to said second end, in a direction which is perpendicular to said parallel planes of said bottom wall and top wall and which forms an angle with said longitudinal direction of the electric connector; and wherein said connecting portion comprises at least two opposite spring contact elements engaged to each other, which have a first end connected to a substantially box-like element and which are extended outwardly from said first end, said box-like element connected to one of said top wall and bottom wall of the damping portion and spaced from said side wall.

2. An electric connector as claimed in claim 1, wherein said side wall lies on a plane offset from the plane of said longitudinal direction and perpendicular to the planes of said bottom wall and top wall.

3. An electric connector as claimed in claim 1, wherein said side wall lies on a plane parallel to the plane of said longitudinal direction and perpendicular to the planes of said bottom wall and top wall.

4. An electric connector as claimed in claim l, wherein said side wall extends in a direction that forms an angle with the vertical direction perpendicular to said longitudinal direction.

5. An electric connector as claimed in claim 3, wherein said substantially box-like element mainly extends along the longitudinal direction of the electric connector and comprises two opposite side walls, the opposite spring contact elements being connected to each side wall of the box-like element.

6. An electric connector as claimed in claim 3, wherein said at least two opposite spring contact elements extend, from said first ends, mainly along said longitudinal direction toward free ends.

* * * * *